United States Patent [19]

Drew

[11] 4,249,048

[45] Feb. 3, 1981

[54] PRESSURE SWITCH

[76] Inventor: Maurice J. Drew, Cylinder, Iowa 50528

[21] Appl. No.: 47,170

[22] Filed: Jun. 11, 1979

[51] Int. Cl.[3] ..... H01H 35/34

[52] U.S. Cl. ..... 200/83 F; 200/83 S; 200/81.6

[58] Field of Search ..... 200/337, 83 R, 83 F, 200/83 S, 83 B, 83 Y, 84 B, 81.6, 81 R; 340/611, 614, 626

[56] References Cited

U.S. PATENT DOCUMENTS

| | | | |
|---|---|---|---|
| 2,355,872 | 8/1944 | Kronmiller | 200/83 F |
| 2,730,591 | 1/1956 | Nielson | 200/84 B |
| 2,773,957 | 12/1956 | Davis | 200/81 R |
| 2,930,866 | 3/1960 | Peterson | 200/83 F |
| 3,132,331 | 5/1964 | Boddy | 200/81.6 |
| 3,358,098 | 12/1967 | Hill | 200/83 R |

FOREIGN PATENT DOCUMENTS

| | | | |
|---|---|---|---|
| 512878 | 11/1930 | Fed. Rep. of Germany | 200/83 F |

*Primary Examiner*—Gerald P. Tolin

*Attorney, Agent, or Firm*—Zarley, McKee, Thomte, Voorhees & Sease

[57] ABSTRACT

A pressure switch has a support structure on which a flexible diaphram is mounted in communication with a source of variable pressure such as a fluid conduit. A first linkage has one end operatively connected to the diaphram and the other end pivotally connected to a cradle having a mercury switch mounted therein. A second linkage is pivotally connected at one end to the support structure and pivotally connected at the other end to the cradle so that the cradle is freely pivotable in response to movements of the first linkage. A quantity of liquid mercury in the mercury switch moves into and out of contact with the mercury switch electrodes in response to pivotal movement of the cradle by the first linkage when the diaphram is moved between first and second positions corresponding to low and high pressure conditions respectively.

5 Claims, 4 Drawing Figures

PRESSURE SWITCH

BACKGROUND OF THE INVENTION

The present invention is directed generally to a pressure switch and more particularly to an improved pressure switch wherein diaphram movement operates a first linkage to pivot a mercury switch supporting cradle to which the first linkage is pivotally connected, the cradle being additionally supported by a second linkage pivotally connected to the cradle and to the pressure switch support structure for free pivotal movement of the cradle.

Pressure switches including a linkage operatively connected to a diaphram are well known. Conventionally, the linkage causes terminal elements to open or close in a contact type switch. The contacts however may become corroded and are susceptible to shorting and other known problems.

SUMMARY OF THE INVENTION

The pressure switch of the present invention includes a support structure having a flexible diaphram mounted thereon in communication with a source of variable pressure such as a fluid conduit. A first linkage is operatively connected at one end to the diaphram for movement therewith and pivotally connected at the other end to a cradle having a mercury switch mounted therein. A second linkage is pivotally connected at one end to the cradle and at the other end to the support structure so as to enable easy pivotal movement of the cradle in response to movement of the first linkage by the diaphram. The mercury switch has electrodes in one portion thereof and a quantity of liquid mercury adapted to electrically connect the electrodes at times. When the flexible diaphram is moved between first and second positions corresponding to low and high pressure conditions respectively, the first linkage pivots the cradle and mercury switch about and with the second linkage between first and second positions for closing and opening the mercury switch respectively. Because the electrical switching is thus accomplished by the mercury switch, the usual problems associated with the terminals of contact type switches are eliminated. Furthermore, the fact that the second linkage is pivotally connected at both ends enables the cradle to pivot freely and easily without any binding of the mechanical supports therefor. This is particularly important in a pressure switch wherein the force and movement of the diaphram may be minimal.

It is therefore a primary object of the invention to provide an improved pressure switch.

A further object is to provide a pressure switch including a mercury switch.

A further object of the invention is to provide such a pressure switch wherein the mercury switch is freely and easily pivotally supported.

A related object of the invention is to provide such a pressure switch wherein the mercury switch cradle is pivotally connected both to a first linkage operatively connected to a diaphram for movement therewith and to a second linkage which is pivotally connected at its opposite end to the switch support structure.

A further object of the invention is to provide a pressure switch which minimizes shock to the mercury switch thereof.

Finally, a further object of the invention is to provide a pressure switch which is economical to manufacture, durable in use and efficient in operation.

DESCRIPTION OF THE PREFERRED EMBODIMENT

The pressure switch 10 of the present invention has a support structure 12 including a lower housing 14 and an upright terminal board 16.

Figure 3:
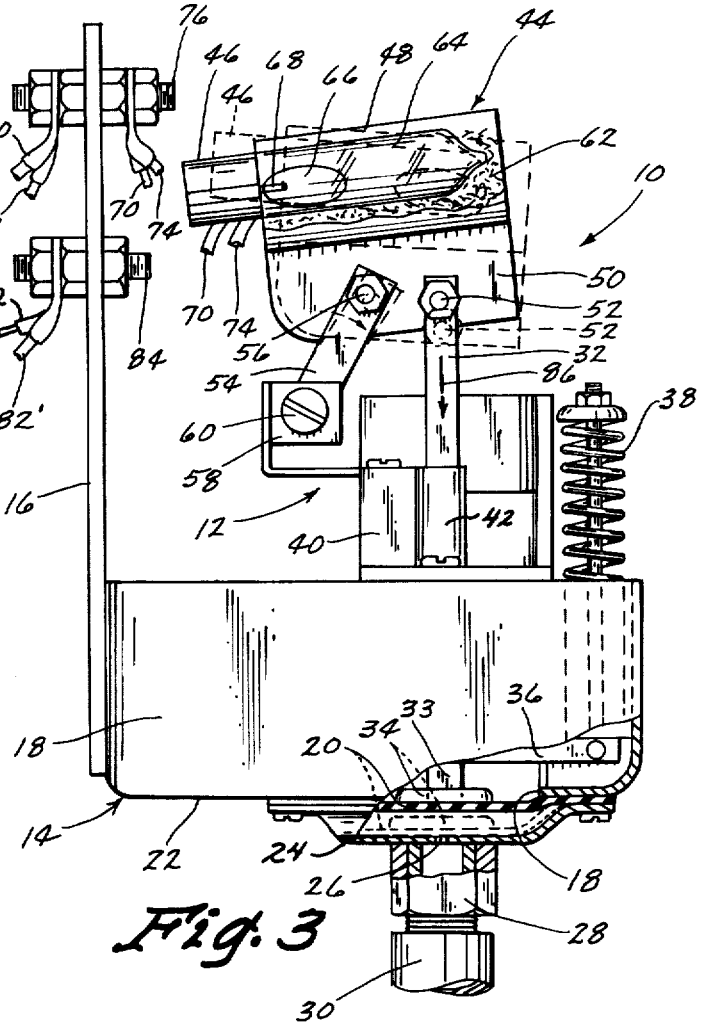
FIG. 3 is a side elevation view, partly in section, taken along line 3—3 in FIG. 2.

Referring to FIG. 3, the housing has a bottom opening 18 which is covered by a diaphram 20 which is secured between the housing bottom wall 22 and an outwardly recessed cover plate 24. A small opening 26 through the center of cover plate 24 provides limited fluid communication between an exterior coupling 28 and the space between the diaphram 20 and cover plate 24. A source of variable pressure conditions, such as a fluid conduit 30 of a water or air pressure system, is connected to coupling 28 for communication of fluid pressure through the small opening 26 to the diaphram 20.

A first linkage 32 is operatively connected at one end to the diaphram 20 by a conventional reversing mechanism such that lever 32 is moved vertically upwardly in response to downward movement of the center of diaphram 20 and vice versa. The reversing mechanism includes a post 33 secured to the diaphram by a contact pad 34 for up and down movement of post 33 with the diaphram and reverse movement of first linkage 32 when the diaphram is vertically moved in response to changing pressure conditions. Post 33 has an arm 36 extended outwardly therefrom for engagement with the underside of an adjustable compression spring 38 for adjusting the amount of pressure required to move the diaphram. The pressure switch as thus far described is conventional. In presently known switches, the first linkage would be connected to one of the terminal elements of a contact type switch for mechanically closing and opening the switch in response to movement of the first linkage with the diaphram. Such switches are susceptible to problems of corrosion, shorting and other problems known to cause the malfunction of such switches.

Figure 1:
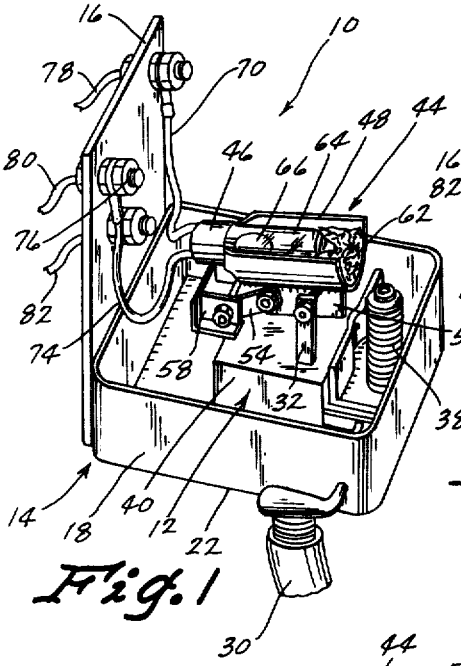
FIG. 1 is a perspective view of the pressure switch of this invention.

According to the present invention, first linkage 32 is directed upwardly through a stationary guide member 40 for up and down sliding movement within a sleeve portion 42 which restricts the first linkage to axial movement therein. The upper end of first linkage 32 is pivotally connected to a cradle 44 which supports a mercury switch 46. In FIG. 1, cradle 44 is shown as being generally Y-shaped in cross section including an open topped channel portion 48 and a downwardly extended flange 50. First linkage 32 is pivotally connected to the flange 50 by a pivot pin 52.

Figure 4:
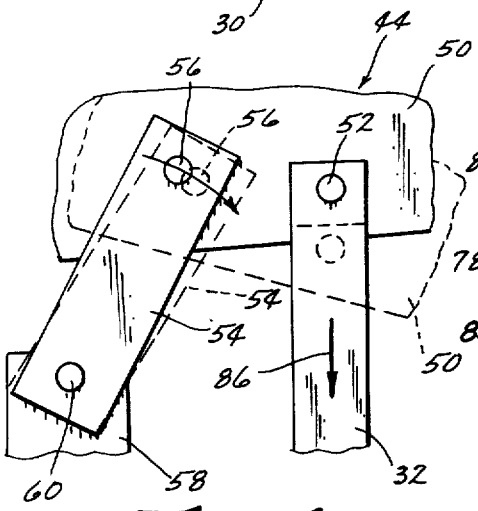
FIG. 4 is an enlarged detail side view showing the relative movement of the first and second linkages for supporting the mercury switch.

Also pivotally connected to flange 50 is the upper end of a second linkage 54 by a pivot pin 56. The lower end of second linkage 54 is pivotally connected to an upstanding wall portion 58 of the stationary guide member 40 by another pivot pin 60. Cradle 44 is thus supported for movement between the solid and dotted line positions therefor in FIGS. 3 and 4 in response to axial movement of first linkage 32 as will be explained in further detail below.

Mercury switch 46 is mounted on the cradle 44 with a foam pad 62 interposed between the cradle and the capsule portion 64 of mercury switch 46 to minimize shock and prevent the breakage thereof. A quantity of liquid mercury 66 is movable within capsule portion 64 toward any and away from a pair of electrodes 68 for making and breaking the electrical connection between them respectively.

Figure 2:
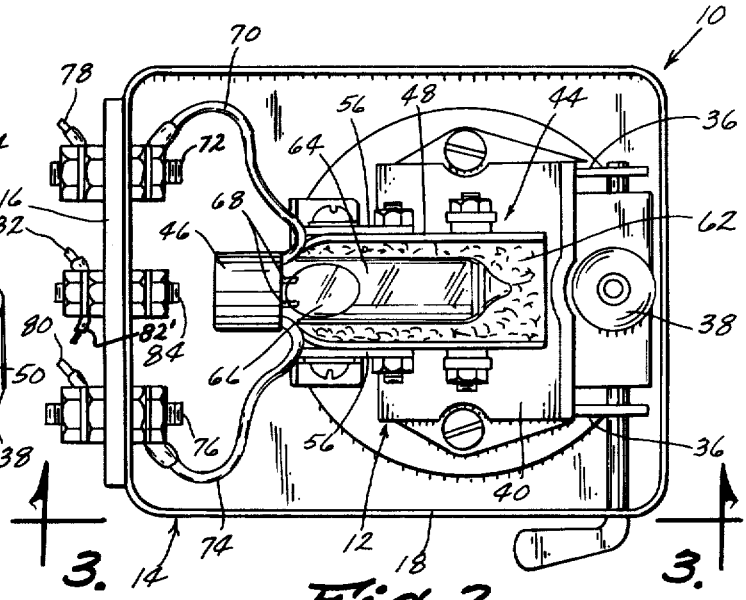
FIG. 2 is an enlarged top plan view of the pressure switch.

Mercury switch 46 may be electrically connected to any device intended to be operated in response to pressure variations within conduit 30. For example, mercury switch 46 may be adapted to control the operation of the water pump (not shown) for maintaining a predetermined pressure within a water supply system to which the fluid conduit 30 is connected. To connect mercury switch 46 to the pump, one electrode is connected by a wire 70 to a first terminal post 72 on terminal board 16 and the other electrode is connected by a wire 74 to a second terminal post 76 as shown in FIGS. 1 and 2. First terminal post 72 is connected to a ground wire 78 which is connected to the source of electric power for the pump. Ground wire 80 connects the second terminal post 76 to the pump. The hot wire 82 for the pump is connected to a third terminal post 84. Hot wire 82' is connected to a source of electrical energy.

In operation, coupling 28 enables the diaphram 20 to be connected in fluid communication with the fluid of a source of variable pressure and mercury switch 46 is electrically connected in the manner described above to a device intended to be operated in response to pressure variations.

Under low pressure conditions, compression spring 38 forces post 33 and diaphram 20 downwardly to the dotted line position thereof in FIG. 3, whereupon first linkage 32 is moved upwardly to pivot the cradle 44 and second linkage 54 to the solid line positions therefor. As a result, the liquid mercury 66 flows downwardly to the left as seen in FIG. 3 towards the electrodes 68 to close mercury switch 46 and thereby activate the water pump, for example, to replenish the system pressure.

Under high pressure conditions, on the other hand, fluid pressure below diaphram 20 forces the diaphram upwardly to the solid line position therefor in FIG. 3 against the urging of compression spring 38. Post 33 is pushed upwardly with the diaphram with the result that the reversing mechanism moves first linkage 32 downwardly as indicated by arrow 86 thereby pivoting cradle 44 to its second or dotted line position shown in FIGS. 3 and 4. The liquid mercury 66 is thus moved by gravity downwardly and to the right as seen in FIG. 3 out of contact with the electrodes 68 to open mercury switch 46 and thereby deactivate the water pump or other such device.

Since the second linkage 54 is pivotally connected at each of its ends to the cradle and support structure 12 respectively, cradle 44 is freely and easily pivoted in response to up and down axial movements of first linkage 32 without any binding of either linkage. Second linkage 54 is inclined downwardly and outwardly relative to first linkage 32 and both linkages are situated substantially within the longitudinal expanse of the cradle. This arrangement enables the first and second linkages to be positioned in relatively closely spaced relation to form a very compact and efficient mechanism. Thus there has been shown and described an improved pressure switch which accomplishes at least all of the stated objects.

I claim:

1. A pressure switch, comprising, a support means, a guide member mounted on said support means, a first linkage means received by said guide member for up and down sliding movement therein, said first linkage being restricted by said guide member to axial movement, a flexible diaphram on said support means in communication with a source of variable pressure conditions, said first linkage means operatively connected to said diaphram for axial movement in response to movement of said flexible diaphram, second linkage means pivotally secured to said support means, cradle means pivotally secured to and supported by each of said first and second linkage means, a mercury switch mounted in said cradle and having electrodes in one portion thereof and a quantity of liquid mercury therein adapted to electrically connect said electrodes at times, whereby when low pressure conditions move said flexible diaphram to a first position, said first linkage means will pivot said cradle means and said mercury switch to a first position about and with said second linkage means to cause said liquid mercury to move towards said electrodes to close said mercury switch, and whereby when high pressure conditions move said flexible diaphram to a second position, said first linkage means will pivot said cradle means and said mercury switch to a second position about and with said second linkage means to cause said liquid mercury to move out of contact with said electrodes to open said mercury switch.

2. The pressure switch of claim 1 wherein said mercury switch includes an elongated capsule containing said quantity of liquid mercury, and further comprising a resilient padding material interposed between said capsule and cradle.

3. The pressure switch of claim 1 wherein the pivotal connection between said second linkage and support means is spaced from said first linkage to a greater extent than the pivotal connection between said second linkage and said cradle means whereby said second linkage is disposed in non-parallel relation to said first linakge.

4. The pressure switch of claim 1 wherein said first and second linkages are situated below and substantially within the longitudinal expanse of said cradle.

5. The pressure switch of claim 1 wherein said cradle comprises an elongated channel portion supporting said mercury switch and a depending flange portion to which said first and second linkages are pivotally connected.

* * * * *